US006932888B2

(12) United States Patent
Matuschczyk et al.

(10) Patent No.: US 6,932,888 B2
(45) Date of Patent: Aug. 23, 2005

(54) FLEXIBLE PRESS COVER AND SHOE PRESS ROLL WITH SUCH A FLEXIBLE PRESS COVER

(75) Inventors: Uwe Matuschczyk, Geislingen (DE); Andreas Meschenmoser, Horgenzell (DE); Joachim Grabscheid, Gerstetten (DE); Andreas Schütte, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/772,898

(22) Filed: Feb. 5, 2004

(65) Prior Publication Data

US 2004/0173275 A1 Sep. 9, 2004

Related U.S. Application Data

(63) Continuation of application No. PCT/EP02/07762, filed on Jul. 12, 2002.

(30) Foreign Application Priority Data

Aug. 6, 2001 (DE) ..... 101 38 526

(51) Int. Cl.[7] ..... D21F 3/00

(52) U.S. Cl. ..... 162/358.4; 162/900; 162/901; 100/118; 100/151; 100/153; 442/239; 428/192; 492/28; 492/48

(58) Field of Search ..... 162/358.4, 900, 162/901; 100/118, 151, 153; 442/239; 492/28, 48; 428/192

(56) References Cited

U.S. PATENT DOCUMENTS

| | | | | |
|---|---|---|---|---|
| 4,229,254 A | * | 10/1980 | Gill | 162/358.4 |
| 4,238,287 A | * | 12/1980 | Gill | 162/358.4 |
| 4,702,952 A | * | 10/1987 | Borel | 428/193 |
| 4,861,434 A | | 8/1989 | Bonander et al. | 162/358 |
| 5,011,578 A | | 4/1991 | Lange et al. | 162/358 |
| 5,134,010 A | | 7/1992 | Schiel | 428/113 |
| 5,375,315 A | | 12/1994 | Griffith et al. | 29/432 |
| 5,422,165 A | * | 6/1995 | Arnold | 428/192 |
| 5,753,083 A | | 5/1998 | Schiel et al. | 162/358.3 |
| 6,116,156 A | * | 9/2000 | Schiel et al. | 100/118 |

FOREIGN PATENT DOCUMENTS

| | | | |
|---|---|---|---|
| DE | 33 38 487 | 5/1985 | F16C/13/00 |
| DE | 35 46 650 | 8/1990 | D21F/3/08 |
| DE | 297 02 362 | 6/1997 | F16C/13/00 |
| DE | 196 33 543 | 2/1998 | D21F/3/08 |
| WO | WO 95/29293 | 11/1995 | D21F/3/02 |

* cited by examiner

*Primary Examiner*—Peter Chin
(74) *Attorney, Agent, or Firm*—Taylor & Aust, P.C.

(57) ABSTRACT

A flexible press cover which has an additional strengthening element in at least one of its two end regions. As a result, in the end region, the tensile strength and the tensile rigidity in the circumferential direction are increased with respect to that hitherto known in such a way that it is no longer necessary to clamp the press cover end region in between two components. Instead, the press cover according to the present invention is suitable to be fixed to the outer circumferential surface of a rotatable supporting element belonging to the cover carrying disk without the aid of an outer ring, a clamping band, clamping filament or the like. In the most beneficial case, the arrangement for fixing the press cover to the aforementioned supporting element is completely free of any kind of fixing elements which would be associated with the cover outer surface.

35 Claims, 5 Drawing Sheets

Fig.1
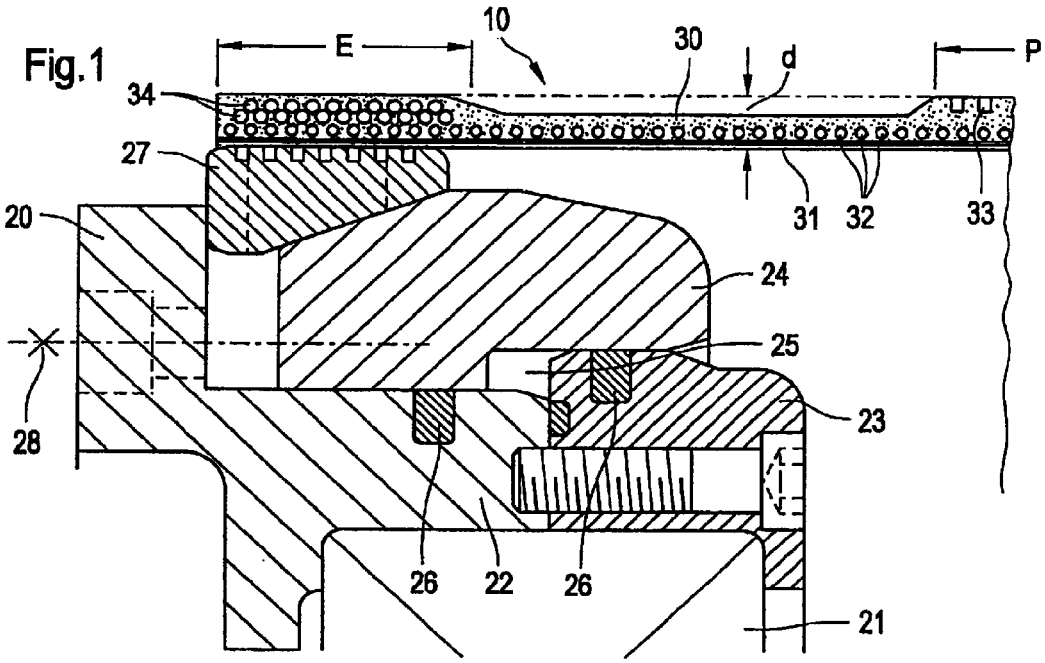
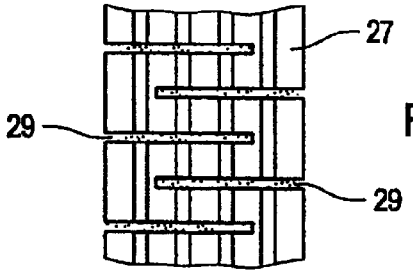
Fig.2
Fig.3
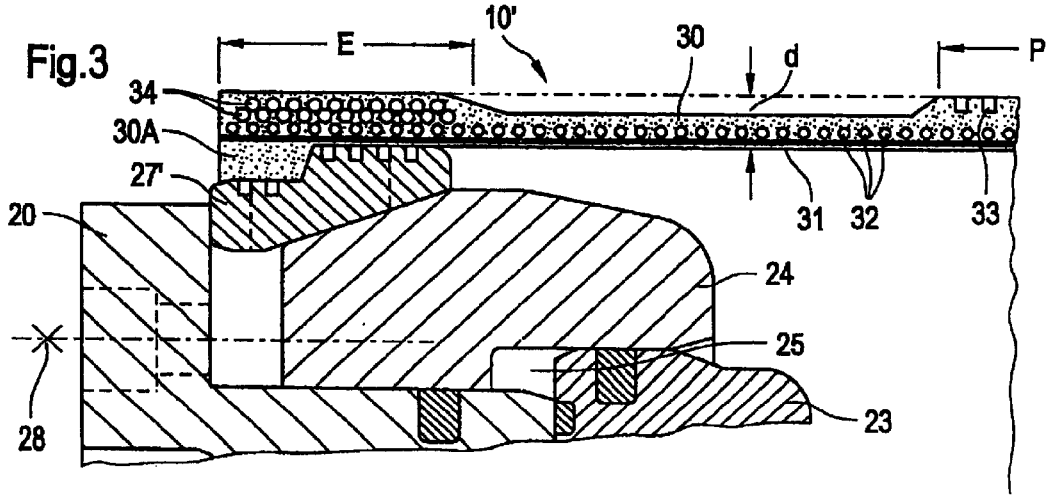

FLEXIBLE PRESS COVER AND SHOE PRESS ROLL WITH SUCH A FLEXIBLE PRESS COVER

CROSS REFERENCE TO RELATED APPLICATIONS

This is a continuation of PCT application No. PCT/EP02/07762, entitled "FLEXIBLE PRESS JACKET AND SHOE PRESS ROLL COMPRISING SUCH A FLEXIBLE PRESS JACKET", filed Jul. 12, 2002.

BACKGROUND OF THE INVENTION

1. Field of the Invention

The present invention relates to a flexible press cover which is intended for a shoe press roll.

2. Description of the Related Art

A shoe press roll of this type is used for dewatering or calendering a moving fibrous web, in particular a paper or board web. The flexible press cover includes a plastic layer, preferably made of polyurethane and, as a strengthening element, a ("conventional") reinforcement embedded in the plastic layer. The reinforcement can be formed as a woven fabric; however, preference is given to what is known as a laid fabric, which includes axially parallel longitudinal filaments and circumferential filaments wound in. The circumferential filaments can be wound into the plastic layer on the outer side of the longitudinal filaments (see EP 0330680= U.S. Pat. No. 5,134,010, PH 04378). However, the opposite arrangement is likewise possible (see WO 95/29293, Tamfelt).

In relation to the prior art, reference is made to the following further documents:

D1: DE 3546650 C2, (PH 04164A),

D2: DE 29702362, (PH 10287),

D3: DE 19633543 (PH 10368).

As is known, a shoe press roll includes a stationary supporting element. Rotatably mounted on the latter are two cover carrying disks for the flexible press cover. In addition, there is arranged on the supporting element a radially displaceable press shoe, which is able to press the revolving press cover against an opposing roll in order to form a press nip extended in the web running direction. It is important that the press cover and the cover carrying disks, together with the supporting element, bound a closed, liquid-tight internal space.

According to document D1, in order to achieve a liquid-tight connection between the press cover end region and one of the cover carrying disks, provision is made to bend over the end region radially inward and to press it against the outer end of the cover carrying disk with the aid of clamping elements.

This arrangement has been tried and tested in practice. However, it is disadvantageous in that a large number of recesses has to be provided in the edge zone of the press cover, between which recesses tongues remain. In some cases, difficulties also arise in achieving the most exact circularity of the press cover.

According to FIGS. 3 and 4 of document D2, attempts have been made to avoid the deformation of the press cover end region described in D1. Each of the two press cover end regions retains the normal cylindrical form, so that the production of recesses and tongues is dispensed with. Provision is made to clamp the cylindrical press cover end region in between an internal expandable (that is to say of enlargeable diameter) spreader ring and an outer ring. However, such an outer ring is frequently disruptive, since the replacement of a worn press cover by a new press cover is more awkward.

According to FIGS. 2 to 4 of document D3, an annular circumferential groove is provided in the outer circumferential surface of a cover carrying disk, into which groove the annular region of the press cover is pressed, specifically by way of a clamping band or by way of a plurality of turns of a high-strength filament or by way of a shrinkage ring. If a covering provided in accordance with FIG. 1 at document D3 is left out, then there is no disruptive outer ring. Nevertheless, this known solution has not been able to gain acceptance in practice.

What is needed in the art is a flexible press cover where the production of recesses and tongues in the press cover end region is superfluous, the mounting of the press cover end region on the respective cover carrying disk is easily achievable, the mounted press cover has good circularity and the outer circumferential surface of the press cover is free of fixing elements.

SUMMARY OF THE INVENTION

The present invention provides a flexible press cover with the following requirements satisfied:

a) the production of recesses and tongues in the press cover end region is superfluous;

b) the mounting of the press cover end region on the respective cover carrying disk is able to be performed with the least possible effort; if the mounting operation is carried out within the papermaking machine, account must be taken of the fact that the mounting space which is available at the two roll ends is often very restricted;

c) the most precise circularity of the finally mounted press cover should be achievable;

d) the outer circumferential surface of the press cover should be free of fixing elements, for example outer rings.

The present invention comprises, in one form thereof, a flexible press cover which has an additional strengthening element in at least one of its two end regions. As a result, in the end region, the tensile strength and the tensile rigidity in the circumferential direction are increased with respect to that hitherto known in such a way that it is no longer necessary to clamp the press cover end region in between two components. Instead, the press cover according to the present invention is suitable to be fixed to the outer circumferential surface of a rotatable supporting element belonging to the cover carrying disk without the aid of an outer ring, a clamping band, clamping filament or the like. In the most beneficial case, the arrangement for fixing the press cover to the aforementioned supporting element is completely free of any kind of fixing elements which would be associated with the cover outer surface.

By virtue of the present invention, it is possible to achieve a number of advantages: the form of the press cover end region remains completely or at least approximately cylindrical. During the mounting of the press cover, deformation of the press cover end region is not necessary; the necessity of producing recesses and tongues is thus also dispensed with. The joining of the press cover end region to a radially outer part or region of the cover carrying disk can be carried out in the same way or at least in a very similar way as the joining of two metal components.

Thus, the mounting of the press cover on the cover carrying disks can be carried out in a simpler way than hitherto known, namely with less effort, so that, if required, even an unpracticed person can be entrusted with the mounting work. A further important advantage is that no outer ring (rotating with the press cover) is required. Likewise, the clamping elements required in accordance with D1 are omitted; this makes it easier to work in restricted conditions of space within the papermaking machine.

The press cover end region advantageously has a constant thickness, measured along axially parallel envelope lines. As a rule, on a finally mounted press cover, not only the outer circumferential surface but also the inner circumferential surface of the press cover end region (having the additional strengthening) are therefore cylindrical. However, a departure from this can be made if required. Specifically, it may be advantageous to design the inner circumferential surface of the press cover end region to be slightly conical, with an internal diameter which increases outward or inward. The fixing of the press cover end region to any kind of annular supporting element belonging to the cover carrying disk (or directly to the carrying disk) can be made easier hereby. In both cases, it can be advantageous to provide a supporting element of which the diameter can be enlarged, that is to say can be spread. However, the use of a non-spreadable ring is also possible, for example a mounting ring, which is inserted into a new press cover to be retrofitted outside the shoe press roll (see DE 101 38 527.7).

The present invention can be applied in flexible press covers with different conventional reinforcements, in particular with woven fabric or laid fabric reinforcement. Different embodiments of the additional strengthening are also specified; this can be formed as an additional or strengthened reinforcement. As an alternative to this or in addition, materials with a modulus of elasticity that is higher in the circumferential direction can be used. One further possibility is for a strengthening ring to be integrated into at least one of the press cover end regions. The object of all these measures is to reduce the extensibility in the circumferential direction of the press cover end region as compared with that hitherto.

Protection is also claimed for a complete shoe press roll having a flexible press cover formed in accordance with the present invention. In this case, at least one of the two cover carrying disks can be adapted in one way or another to the press cover end region formed in accordance with the present invention. Details are explained further below within the context of the figure description.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1 is a partial longitudinal sectional view through a shoe press roll having an embodiment of a flexible press cover according to the present invention;

FIG. 2 is a partial view of an embodiment of a spreader ring belonging to the shoe press roll according to the present invention;

FIGS. 3–6 illustrate variants of FIG. 1 according to the present invention;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 4:
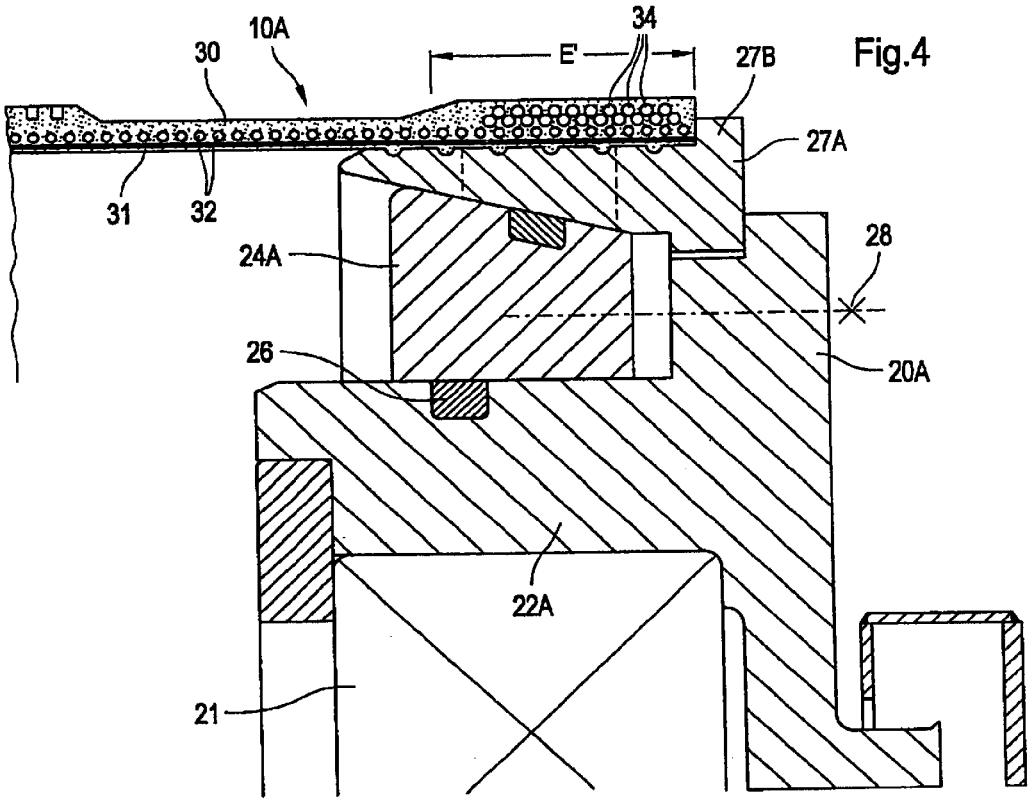

Referring now to the drawings, and more particularly to FIG. 1, there is shown a shoe press roll, only one of the two end regions of flexible press cover 10 and its fixing to a rotatable cover carrying disk 20. The latter is mounted in a known way on a supporting element, not visible, by way of a rolling contact bearing 21. Likewise not illustrated is a press shoe, using which press cover 10 can be pressed against an opposing roll. These and further known details of a shoe press device can be seen, for example, from DE 19522761 (PH 10178).

Press cover 10 is substantially composed of a plastic layer 30, for example of polyurethane, with a conventional reinforcement embedded therein as a strengthening elements; the reinforcement includes, axially parallel longitudinal filaments 31 and circumferential filaments 32 wound thereon. The thickness d of press cover 10 is chosen such that grooves or blind holes 33 can be provided within the pressing zone P. In the end region E, press cover 10 has substantially the same thickness d as in pressing zone P. In end region E, as additional strengthening (that is to say in addition to conventional reinforcement 31, 32), additional circumferential filaments 34 of the highest possible tensile strength and tensile rigidity (high modulus of elasticity) are embedded in plastic layer 30.

According to the present invention, circumferential filaments 34 form an additional reinforcement, produced from high-strength plastic or metal filaments or wires. As compared with circumferential filaments 32 of the conventional reinforcement, the additional circumferential filaments or wires 34 can have a larger filament diameter and/or be formed from a material which has a higher tensile strength and, in particular, a higher modulus of elasticity (e.g. Kevlar). However, it is also possible to choose the same diameter and/or the same material for filaments 32 and 34, preferably a material with a relatively high modulus of elasticity. In addition, the plastic layer can be formed from a material with an increased modulus of elasticity. Between end region E and pressing zone P, press cover 10 can have a zone of lower thickness, in order to increase its flexibility precisely where increased deformation takes place during operation.

Cover carrying disk 20 includes an integrally molded collar 22 and an extension ring 23 screwed to the latter. Collar 22 and ring 23 engage around rolling contact bearing 21 and, on their outer side, bear an axially displaceable clamping ring, which is formed as an annular piston 24. The three aforementioned components 22, 23 and 24 are shaped in such a way that an annular space 25, to which a pressurized medium can be applied, is formed between them. As a result, annular piston 24 can be displaced outward hydraulically or pneumatically parallel to the roll axis. Sealing rings 26 are used to seal off the annular space 25.

In order to connect press cover 10 to cover carrying disk 20, spreader ring 27 is provided. The latter has a cylindrical outer circumferential surface, provided with recesses if required, which engages in the cylindrical inner circumferential surface of the press cover end region E. Spreader ring 27 has a conical inner circumferential surface, which interacts with a conical outer circumferential surface of annular piston 24. In the event of axial displacement of annular piston 24 (to the left in FIG. 1), spreader ring 27 (which bears axially on cover carrying disk 28) is widened, and therefore a secure, liquid-tight connection is made between press cover 10 and cover carrying disk 20. By virtue of additional reinforcement 34, an external clamping link is no longer required in the press cover end region.

The axial displacement of annular piston 24 can also be carried out with the aid of screws (indicated at 28). Screws 28 of this type can also be used for the axial fixing of annular piston 24 after the annular piston has been displaced hydraulically or pneumatically. FIG. 2 shows spreader ring 27 from the outside. This ring is given its ability to spread by slots 29 machined in alternately from both sides, in which a highly elastic filler is provided, in order that the necessary hermetic sealing of the roll internal space is ensured.

FIG. 3 differs from FIG. 1 in that, in end region E on press cover 10', provision is made for bead 30A projecting radially inward, which fits into a turned recess in spreader ring 27'. In this way, the accuracy of the axial fixing of press cover 10' to carrying disk 20 is increased.

Press cover 10A of the exemplary embodiment illustrated in FIG. 4 is similar to that of FIG. 1; only length E' of the press cover end region has been enlarged somewhat, corresponding to the greater axial length of spreader ring 27A. Cover carrying disk 20A again has collar 22A to accommodate rolling contact bearing 21. Between collar 22A and spreader ring 27A there is a simple clamping ring 24A. The latter is displaced axially in the outward direction merely with the aid of screws 28, enlarging the outer diameter of the spreader ring with its conical outer. circumferential surface, which interacts with a conical inner circumferential surface of spreader ring 27A, in order to produce a secure connection to press cover 10A. Integrally molded on spreader ring 27A is collar 27B, which again makes the accurate axial fixing of press cover to carrying disk 20A easier.

In a shoe press roll according to the present invention, both ends of the roll can be constructed in accordance with FIG. 1. Another possibility is for one end of a shoe press roll to be configured in accordance with FIG. 1 or FIG. 3, but, on the other hand, for the other end of the roll to be figured in accordance with FIG. 4 or in accordance with FIG. 5 or 6 described below.

Figure 5:
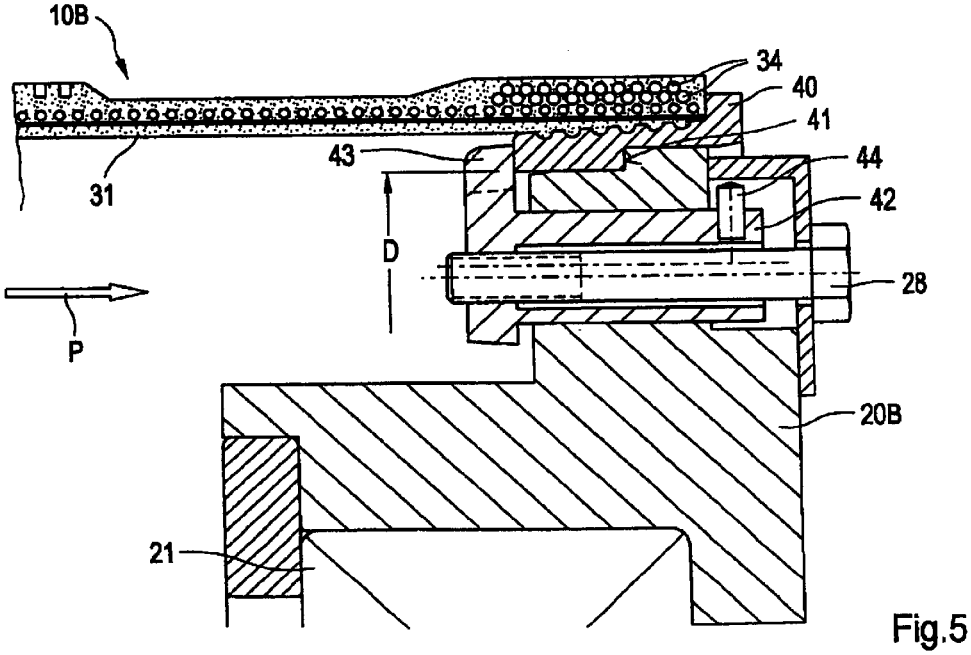

Press cover 10B of the exemplary embodiment illustrated in FIG. 5 differs from press cover 10A of FIG. 4 only in the fact that the inner circumferential surface in the end region is not continuously cylindrical but is slightly conical a short distance from the outside, with an internal diameter that decreases from the outside toward the inside.

This makes it easier to insert mounting ring 40, which has a corresponding conical outer circumferential surface. The insertion of this ring 40 (and the fixing of the same in press cover 10B, for example by way of adhesive) is preferably carried out outside the shoe press roll, that is to say before the removal of a press cover that has worn and is to be replaced. For fixing mounting ring 40 bearing press cover 10B to cover carrying disk 20B, the following is provided: the outer circumferential surface of cover carrying disk 20B is offset at 41. The inner circumferential surface of strengthening ring 40 has a corresponding offset, in the example illustrated, a relatively small internal diameter D being followed by a larger internal diameter in the axial direction from the inside to the outside. In this way, press cover 10B, together with pre-mounted mounting ring 40, can be pushed onto cover carrying disk 20B in the direction of the arrow P over the entire (not illustrated) stationary supporting element. This is possible by virtue of the fact that the aforementioned relatively small internal diameter D of ring 40 is still somewhat larger than the external dimensions of the stationary supporting element, including the press shoe and further accessories. In order to screw ring 40 to cover carrying disk 20B, the following is provided: bush 42 is rotatably mounted in a bore in cover carrying disk 20B. Integrally molded at the inner end of bush 42 is a nose flange 43; a radial pin 44 is inserted into the outer end. In the illustrated position of bush 42, the nose of nose flange 42 acts on the inner end of ring 40. However, as a result of rotation of bush 42, the nose permits the strengthening ring to pass when inserted in the direction of the arrow P. In order to fix mounting ring 40 (together with press cover 10B) to cover carrying disk 20B with the aid of the aforementioned nose flange 43, a screw 28 is provided. A plurality of such arrangements are distributed over the circumference of cover carrying disk 20B.

Figure 6:
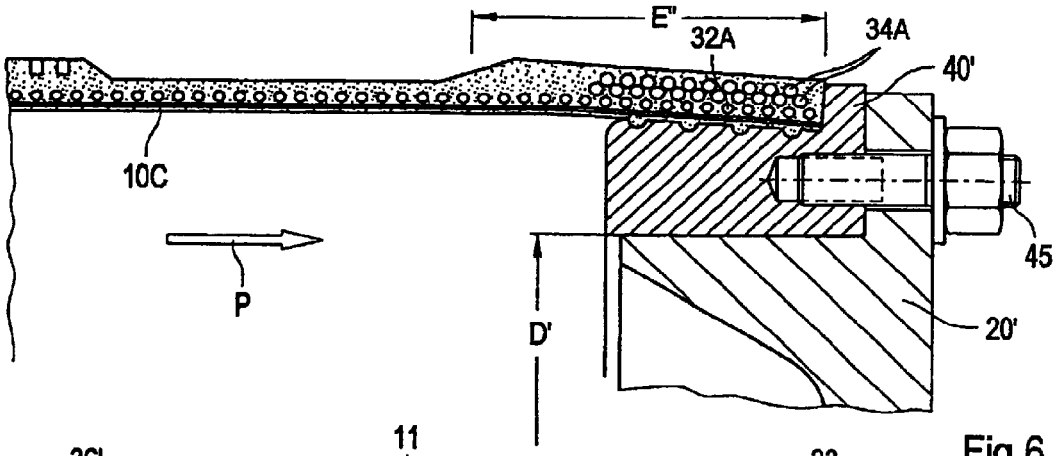

FIG. 6 shows a simplified alternative to FIG. 5. Mounting ring 40' here has a smooth inner circumferential surface (without offset 41 shown in FIG. 5); in addition, bush 42 has been omitted. Mounting ring 40' is screwed to cover carrying disk 20' by way of simple studs 45. In this design, however, a smaller internal diameter D' of mounting ring 40' will generally be needed than in FIG. 4. In order that, as the press cover is drawn in, mounting ring 40' can nevertheless pass the stationary supporting element with its accessories, it may be necessary to arrange some of these accessories such that they can move on the supporting element; see the parallel patent application DE 101 38 527.7

For fixing press cover 10C to mounting ring 40', the following is provided: the mounting ring has a conical outer circumferential surface that tapers in the outward direction. In addition, in press cover end region E", circumferential filaments 32A and/or 34A are wound in with increased prestress, so that end region E" likewise tapers conically in the outward direction. Press cover 10C is fixed onto mounting ring 40' in a manner similar to the fixing of a vehicle tire to its rim. The press cover design with circumferential filaments wound in under increased prestress can also be combined with a mounting ring whose outer circumferential surface is cylindrical.

Figure 7:
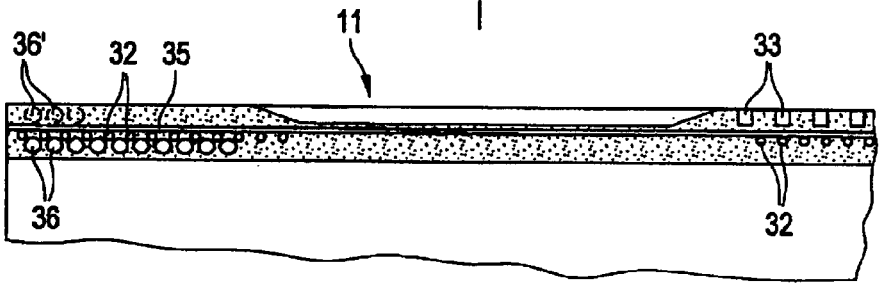
FIGS. 7–13 illustrate various modifications of the press cover end region in longitudinal section according to the present invention.

FIG. 7 shows press cover 11 which is modified with respect to FIG. 1 and whose conventional reinforcement (differing from FIG. 1) has axially parallel longitudinal filaments 35 arranged outside circumferential filaments 32 (corresponding to WO '293). As additional reinforcement, circumferential filaments 36 are provided, which are preferably wound onto the reinforcement 32, 35 from the inside. As an alternative to this or in addition, in order to strengthen the press cover end region further, circumferential filaments 36' which are wound onto the reinforcement 32, 35 from the outside can be provided.

Figure 8:
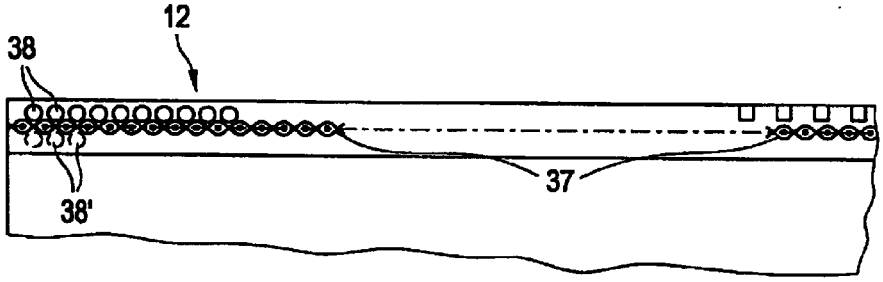

Press cover 12 illustrated in FIG. 8 has, as reinforcement, a woven fabric 37. As additional reinforcement of the press cover end region, circumferential filaments 38 are provided, which are wound onto woven fabric 37 from the outside. Alternatively to this or additionally, circumferential filaments 38' arranged radially on the inside can be provided.

In the exemplary embodiments according to FIGS. 7 and 8, both press cover end regions can be designed identically.

Figure 9:
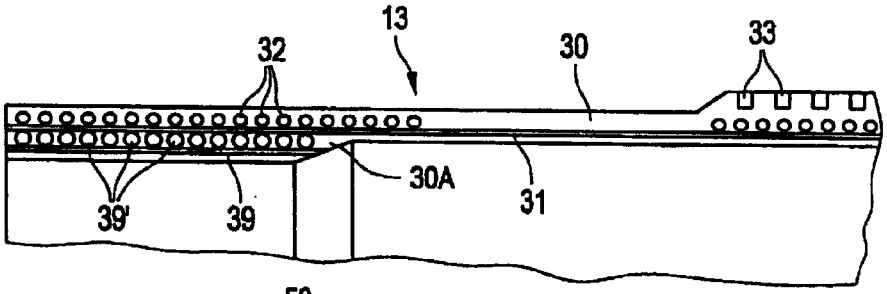

By contrast, the variant illustrated in FIG. 9 can be provided only at one of the two press cover ends. This results from the production method according to EP 0330680 (production of the press cover on the outer side of a cast cylinder). In detail, FIG. 9 shows a press cover 13 whose reinforcement 31, 32 corresponds to that of the press cover 10 illustrated in FIG. 1. The illustrated end region of press cover 13 has, in a way similar to FIG. 3, a thickening 30A projecting radially inward. Located in this is an additional reinforcement, which can be formed as a woven fabric or (as illustrated) as a laid fabric, including axially parallel longitudinal filaments 39 and circumferential filaments 39' wound thereon. In addition, a thickening (not illustrated) projecting radially outward can be provided, similar to that of FIG. 1 or 3.

Figure 10:
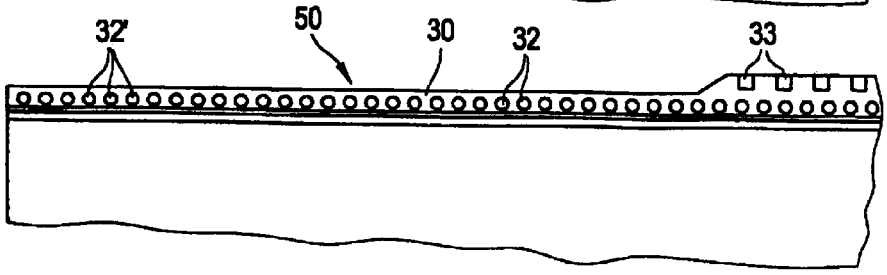

FIG. 10 shows a press cover 50 according to the present invention whose end region has no thickening. Here, the additional strengthening is formed by circumferential filaments 32' being wound more densely in the end region than circumferential filaments 32 located outside the end region. Circumferential filaments 32 and 32' can include the same material. As an alternative to this, circumferential filaments 32' can also be formed from a material with an increased modulus of elasticity. In addition, in the end region, plastic layer 30 can be produced from a material with an increased modulus of elasticity.

FIGS. 11 to 15 show embodiments of the press cover according to the present invention in which a strengthening ring (of plastic or metal) is integrated into the end region of the press cover as additional strengthening. According to FIG. 11, the thickness d of the axially outer region 52 of strengthening ring 51 is substantially the same as or greater than the thickness of end region E of press cover 10 of FIG. 1. The axially inner region 53 is substantially thinner and overlaps the end of press cover 54, initially produced in the conventional way (EP'680), with its conventional reinforcement 31, 32. Ring 51 is fixed by casting on an additional plastic layer 55 and winding in additional circumferential filaments 56 at the same time. Press cover 54 is fixed to the cover carrying disk in the same way as in FIG. 1 or 4 or by way of screws which engage directly in strengthening ring 51 in the axial direction (see threaded hole 59).

Figure 11:
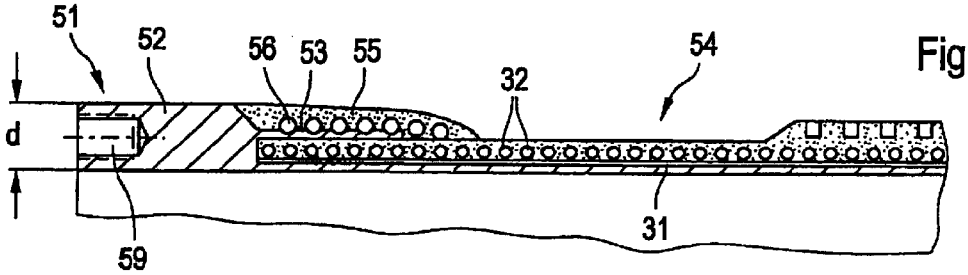
Figure 12:
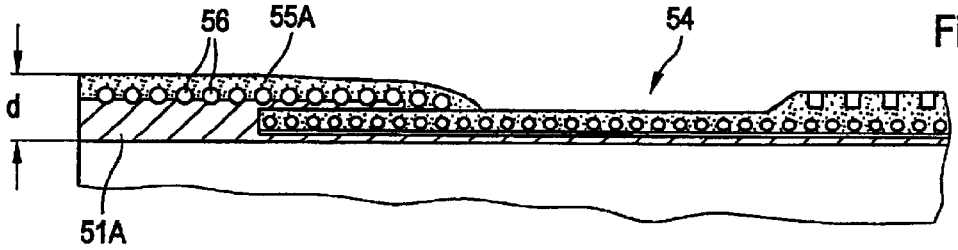

FIG. 12 differs from FIG. 11 in that strengthening ring 51A is thinner in its axially outer region than the thickness d of the finished press cover end region, and in that it is sheathed over its entire length by the additional plastic layer 55A with additional circumferential filaments 56.

Figure 13:
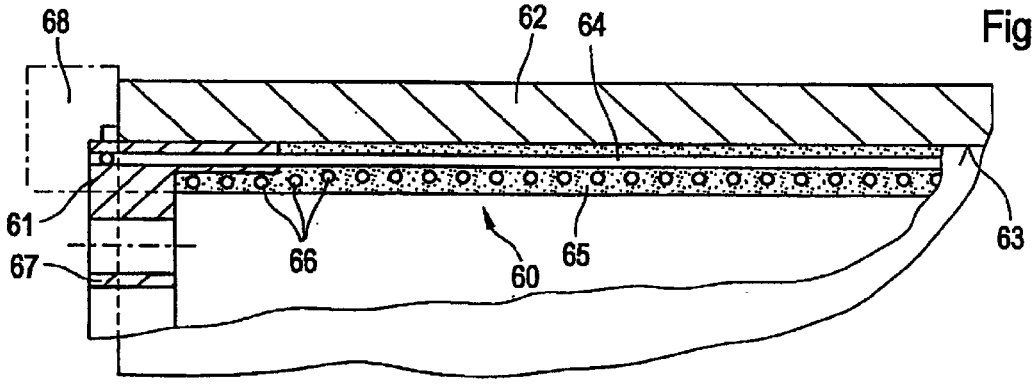

FIG. 13 shows the end region of a press cover 60 produced in accordance with WO '293 with strengthening ring 61. Illustrated schematically is a cast cylinder 62 with its inner circumferential surface 63. Firstly, during the production of the press cover 60, strengthening ring 61 fixed to cast cylinder 62 and is used to clamp the longitudinal filaments 64 on. Plastic layer 65 is then cast, circumferential filaments 66 simultaneously being wound from the inside onto longitudinal filaments 64 and strengthening ring 61. In order to fix press cover 60 to a cover carrying disk (not illustrated), strengthening ring 61 has flange 67 projecting radially inward. Alternatively, flange 68 projecting radially outward could be provided.

Figure 14:
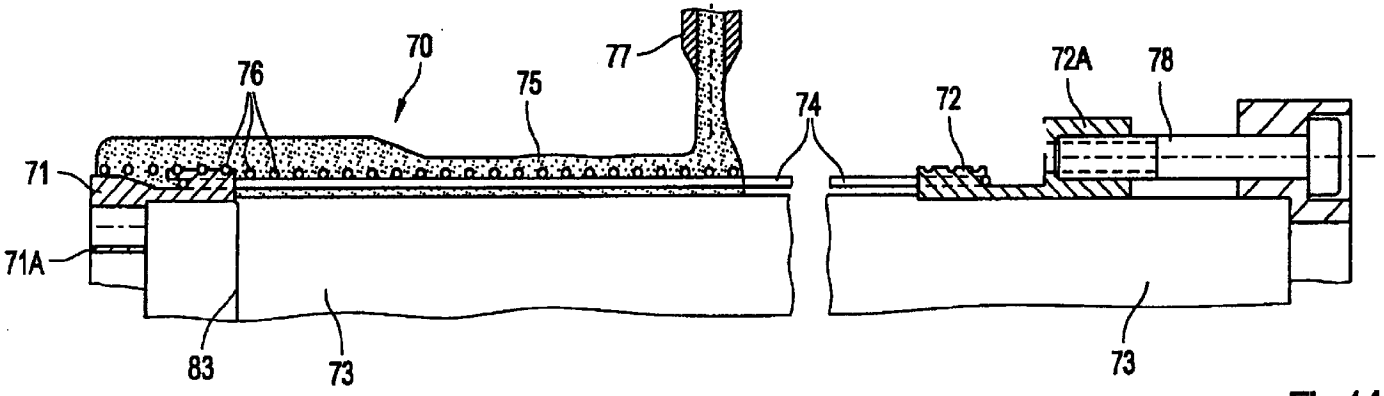
FIG. 14 illustrates an embodiment of the method of producing a press cover on the outer circumferential surface of a cast cylinder according to the present invention.

FIG. 14 shows the production method of a press cover 70 with strengthening rings and 71 and 72. The production method similar to that of EP '680, with a cast cylinder 73 on whose circumferential outer surface the production takes place. Differing from EP '680, instead of clamping rings, strengthening rings 71 and 72 are provided, which are used initially to clamp longitudinal filaments 74 on and which, after plastic layer 75 has been cast on and circumferential filaments 76 have simultaneously been wound on, remain a constituent part of press cover 70. The secure fixing of strengthening rings 71 and 72 in press cover 70 is achieved by the longitudinal filaments 74 (as disclosed by EP '680) being drawn in a meandering fashion through strengthening rings 71, 72 and then being tensioned, additionally by the fact that circumferential filaments 76 are wound onto the strengthening rings with a certain prestress. FIG. 14 also shows how casting nozzle 77 moves from one end of cast cylinder 73 to the other during the casting operation, while the cylinder rotates at the same time.

One strengthening ring 71 has flange 71*a* projecting radially inward, which bears on one end of cast cylinder 73. The other strengthening ring 72 has flange 72*a* projecting radially outward, in which clamping screws 78 engage in order to tension longitudinal filaments 74.

Figure 15:
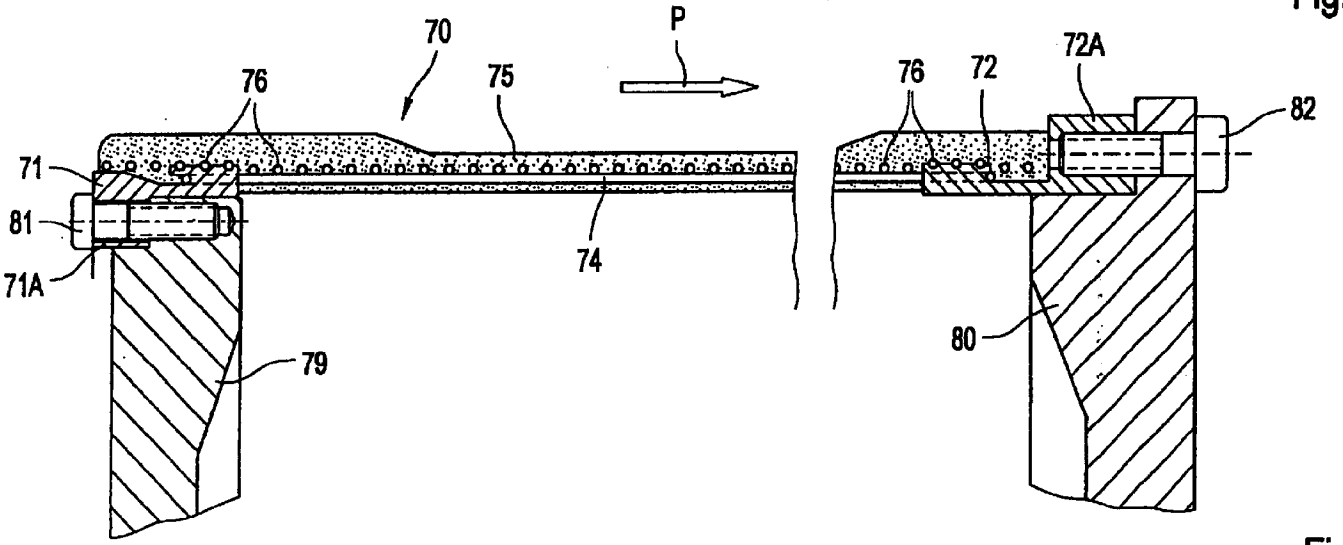
FIG. 15 illustrates an embodiment of the press cover produced in accordance with FIG. 14 in the finally mounted state.

FIG. 15 shows the press cover 70 produced in accordance with FIG. 14 in the finished state mounted on cover carrying disks 79 and 80. In this case, flanges 71*a* and 72*a* are used for fixing the press cover to the carrying disks, in each case with the aid of screws 81, 82. Each of the two strengthening rings 71, 72 is centered on an outer circumferential surface of its cover carrying disk. In order to make it easier to draw in press cover 70 in the axial direction (arrow P), the diameter of the outer circumferential surface of carrying disk 79 on the left (in FIG. 15) is smaller than that of the right-hand carrying disk 80. Accordingly, cast cylinder 73 in FIG. 14 is offset slightly at 83.

Figure 16:
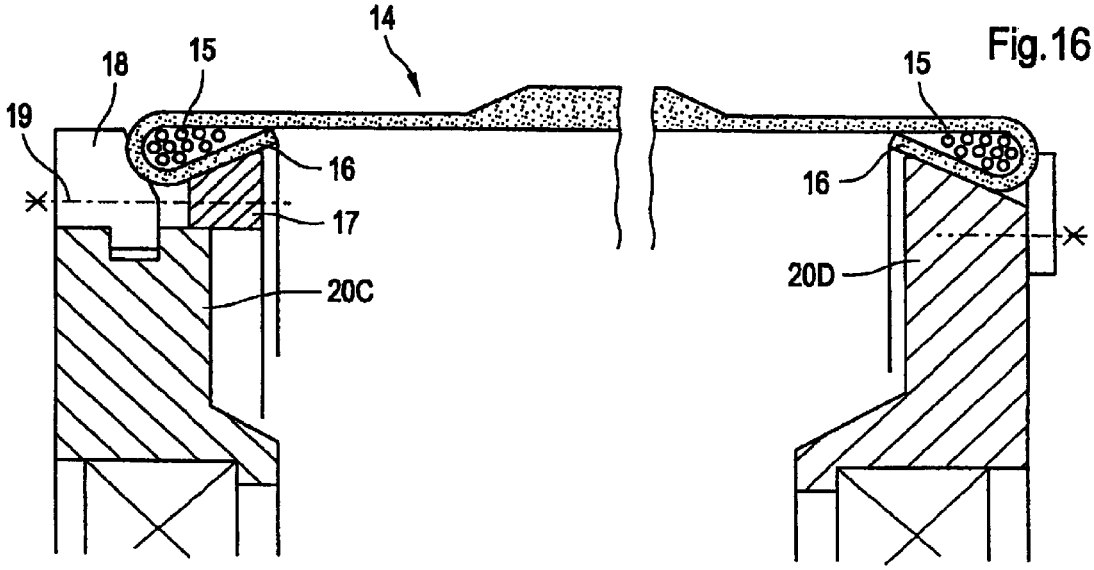
FIG. 16 illustrates a further variant of a shoe press roll having a flexible press cover according to the present invention.

In the case of press cover 14 illustrated in FIG. 16 (whose conventional reinforcement is not illustrated), additional strengthening is formed as an end section 16 of the press cover which is folded inward (or turned over). Additional reinforcement 15 is provided therein. As FIG. 16 shows, the inner circumferential surface of the inwardly folded end section 16 is conical with an internal diameter increasing in the inward direction. As a result, press cover 14 is fixed to cover carrying disks 20C and 20D in a manner similar to the fixing of a vehicle tire to a rim. One press cover end section preferably rests directly on cover carrying disk 20D, which has a corresponding conical outer circumferential surface. The other end section rests on clamping ring 17, which likewise has a corresponding conical outer circumferential surface and which can be displaced in an axially parallel manner on cover carrying disk 20C. A plurality of ring segments 18 can be inserted into cover carrying disk 20C in the radial direction from the outside to the inside. Through said segments there extend screws 19, using which the press cover end section can be clamped in between clamping ring 17 and ring segments 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A flexible press cover for a shoe press roll used for at least one of dewatering and calendaring a moving fibrous web, said flexible press cover comprising:

a plastic layer;

a conventional reinforcement embedded in said plastic layer, said conventional reinforcement used as a strengthening element, said conventional reinforcement being one of a woven fabric and a laid fabric, said laid fabric including a plurality of axially parallel longitudinal filaments and a plurality of circumferential filaments;

a first end region and a second end region associated with said flexible press cover; and an additional strengthening element in a form of at least one additional filament in at least one of said first end region and said second end region, said additional strengthening element making said flexible press cover suitable to be fixed to a rotatable supporting element of the shoe press roll, said rotatable supporting element having a round shape.

2. The flexible press cover of claim 1, wherein said rotatable supporting element is a spreader ring.

3. The flexible press cover of claim 1, further including an outer circumferential surface on said rotatable supporting element, said flexible press cover suitable to be fixed to said outer circumferential surface.

4. The flexible press cover of claim 3, further including an arrangement for fixing said flexible press cover to said rotatable supporting element, said arrangement being free of fixing elements associated with said outer circumferential surface.

5. The flexible press cover of claim 1, further including an inner circumferential surface of said flexible press cover in at least one of said first end region and said second end region having said additional strengthening elements, said inner circumferential surface being cylindrical.

6. The flexible press cover of claim 1, further including an inner circumferential surface of said flexible press cover in at least one of said first end region and said second end region having said additional strengthening elements, said inner circumferential surface being conical with an internal diameter that one of increases and decreases in an outward direction.

7. The flexible press cover of claim 6, wherein said rotatable supporting element can be spread to enlarge a diameter of said rotatable supporting element.

8. The flexible press cover of claim 1, wherein said at least one additional filament has an additional plurality of circumferential filaments which are wound onto said conventional reinforcement from an outside of said conventional reinforcement.

9. The flexible press cover of claim 1, wherein said at least one additional filament has an additional plurality of circumferential filaments which are wound onto said conventional reinforcement from an inside of said conventional reinforcement.

10. The flexible press cover of claim 1, wherein said additional strengthening elements include a thickened bead with an internal diameter which is smaller than an internal diameter of a remaining of said flexible press cover.

11. The flexible press cover of claim 10, wherein said additional strengthening is in only one of said at least one of said first end region and said second end region.

12. The flexible press cover of claim 1, wherein said in that the additional reinforcement has at least one band.

13. The flexible press cover of claim 1, wherein said at least one band is a woven fabric band.

14. The flexible press cover of claim 1, wherein in said at least one of said first end region and said second end region having said additional strengthening elements there is a greater thickness than an adjacent press cover region.

15. The flexible press cover of claim 1, wherein said additional strengthening elements includes a strengthening ring prefabricated from one of a plastic and a metal.

16. A flexible press cover for a shoe press roll used for at least one of dewatering and calendaring a moving fibrous web, said flexible press cover comprising:

a plastic layer;

a conventional reinforcement embedded in said plastic layer, said conventional reinforcement used as a strengthening element, said conventional reinforcement being one of a woven fabric and a laid fabric, said laid fabric including a plurality of axially parallel longitudinal filaments and a plurality of circumferential filaments;

a first end region and a second end region associated with said flexible press cover; and an additional strengthening element in a form of at least one additional filament in at least one of said first end region and said second end region, said additional strengthening element making said flexible press cover suitable to be fixed to a rotatable supporting element of the shoe press roll, said additional strengthening elements including a thickened bead with an internal diameter which is smaller than an internal diameter of a remaining of said flexible press cover, further including an other additional reinforcement being provided in said thickened bead.

17. The flexible press cover of claim 16, wherein said other additional reinforcement is at least one of said plurality of axially parallel longitudinal filaments, said plurality of wound circumferential filaments and said woven fabric.

18. A flexible press cover for a shoe press roll used for at least one of dewatering and calendaring a moving fibrous web, said flexible press cover comprising:

a plastic layer;

a conventional reinforcement embedded in said plastic layer, said conventional reinforcement used as a strengthening element, said conventional reinforcement being one of a woven fabric and a laid fabric, said laid fabric including a plurality of axially parallel longitudinal filaments and a plurality of circumferential filaments;

a first end region and a second end region associated with said flexible press cover; and an additional strengthening element in a form of at least one additional filament in at least one of said first end region and said second end region, said additional strengthening element making said flexible press cover suitable to be fixed to a rotatable supporting element of the shoe press roll, wherein said additional strengthening elements being formed of additional circumferential filaments which form a continuation of said conventional reinforcement, said additional circumferential filaments being formed by at least one of an increased winding density and an increased filament thickness.

19. A flexible press cover for a shoe press roll used for at least one of dewatering and calendaring a moving fibrous web, said flexible press cover comprising:

a plastic layer;

a conventional reinforcement embedded in said plastic layer, said conventional reinforcement used as a strengthening element;

a first end region and a second end region associated with said flexible press cover; and an additional strengthening element in a form of a strengthening ring in at least one of said first end region and said second end region, said strengthening ring being prefabricated from one of a plastic and a metal, said additional strengthening element making said flexible press cover suitable to be fixed to a rotatable supporting element of the shoe press roll, at least part of said strengthening ring is cast into said flexible press cover, as viewed in cross section through said strengthening ring.

20. The flexible press cover of claim 19, wherein said rotatable supporting element is a spreader ring.

21. The flexible press cover of claim 19, further including an outer circumferential surface on said rotatable supporting element, said flexible press cover suitable to be fixed to said outer circumferential surface.

22. The flexible press cover of claim 19, wherein said strengthening ring is anchored in said flexible press cover with an aid of a plurality of reinforcing filaments.

23. The flexible press cover of claim 19, wherein said strengthening ring is cast in following a casting of said plastic layer.

24. The flexible press cover of claim 19, wherein said strengthening ring is cast in at the same time as a cast of said plastic layer.

25. The flexible press cover of claim 19, wherein said strengthening ring has a flange for fixing said flexible press cover to said rotatable supporting element belonging to the shoe press roll.

26. The flexible press cover of claim 25, wherein said rotatable supporting element is a cover carrying disk.

27. A shoe press roll, comprising:

a flexible press cover including a plastic layer, a conventional reinforcement embedded in said plastic layer, said conventional reinforcement used as a strengthening element, said conventional reinforcement being one of a woven fabric and a laid fabric, said laid fabric includes a plurality of axially parallel longitudinal filaments and a plurality of circumferential filaments; a first end region and a second end region associated with said flexible press cover; an additional strengthening element in a form of at least one additional filament in at least one of said first end region and said second end region, a cover inner surface of said flexible press cover in at least one of said first end region and said second end region having said additional strengthening elements, and an outer circumferential surface;

a stationary supporting element having a round shape;

a first roll end and a second roll end associated with said shoe press roll; and a first rotatable cover carrying disk at said first roll end, a second rotatable cover carrying disk at said second roll end, said first rotatable cover carrying disk and said second rotatable cover carrying disk mounted on said stationary supporting element, at least one of said first rotatable cover carrying disk and said second rotatable cover carrying disk including a clamping ring which can be displaced axially on an outer circumferential surface of said at least one of said first rotatable cover carrying disk and said second rotatable cover carrying disk, said clamping ring having a conical outer surface which engages in a conical inner surface of a ring that can be spread, said ring that can be spread resting in said cover inner surface, and an absence of fixing elements associated with said outer circumferential surface of said flexible press cover.

28. The shoe press roll of claim 27, wherein said clamping ring can be displaced axially by way of at least one screw.

29. The shoe press roll of claim 27, wherein said clamping ring can be displaced axially by way of a hydraulic pressure chamber.

30. The shoe press roll of claim 27, wherein said ring that can be spread has a collar for an axial fixing of said flexible press cover.

31. A shoe press roll, comprising:

a flexible press cover including a plastic layer, a conventional reinforcement embedded in said plastic layer, said conventional reinforcement used as a strengthening element, said conventional reinforcement being one of a woven fabric and a laid fabric, said laid fabric includes a plurality of axially parallel longitudinal filaments and a plurality of circumferential filaments; a first end region and a second end region associated with said flexible press cover; an additional strengthening element in a form of at least one additional filament in at least one of said first end region and said second end region, a cover inner surface of said flexible press cover in at least one of said first end region and said second end region having said additional strengthening elements and an outer circumferential surface;

a stationary supporting element having a round shape;

a first roll end and a second roll end associated with said shoe press roll;

a first rotatable cover carrying disk at said first roll end, a second rotatable cover carrying disk at said second roll end, said first rotatable cover carrying disk and said second rotatable cover carrying disk mounted on said stationary supporting element;

a mounting ring being provided which, outside said flexible press roll, can be inserted into at least one of said first end region and said second end region having said additional strengthening elements, and, subsequent to said mounting ring being inserted, can be fixed to at least one of said first rotatable cover carrying disk and said second rotatable cover carrying disk together with said flexible press cover.

32. The shoe press roll of claim 31, wherein said mounting ring has a conical outer circumferential surface matching a conical inner circumferential surface of said flexible press cover in at least one of said first end region and said second end region which has said additional strengthening elements.

33. The shoe press roll of claim 31, wherein said mounting ring has a substantially cylindrical outer circumferential surface.

34. The shoe press roll of claim 31, wherein said mounting ring can be inserted into an end region of said flexible press cover which is tapered conically outward.

35. The shoe press roll of claim 31, wherein said mounting ring has a collar for an axial fixing of said flexible press cover.

* * * * *